US005704434A

United States Patent [19]

Schoeps

[11] Patent Number: 5,704,434

[45] Date of Patent: Jan. 6, 1998

[54] HYDRAULIC TORQUE IMPULSE MECHANISM

[75] Inventor: Knut Christian Schoeps, Tyresö, Sweden

[73] Assignee: Atlas Copco Tools AB, Nacka, Sweden

[21] Appl. No.: 579,611

[22] Filed: Dec. 26, 1995

[30] Foreign Application Priority Data

Dec. 30, 1994 [SE] Sweden ..... 9500002

[51] Int. Cl.[6] ..... B25B 21/02; B25B 23/145

[52] U.S. Cl. ..... 173/93.5; 173/218; 173/168

[58] Field of Search ..... 173/93, 93.5, 168, 173/169, 170, 90, 218, 221

[56] References Cited

U.S. PATENT DOCUMENTS

| | | | |
|---|---|---|---|
| 3,283,537 | 11/1966 | Gillis . | |
| 4,683,961 | 8/1987 | Schoeps | 173/93 |
| 4,767,379 | 8/1988 | Schoeps | 173/93.5 |
| 4,836,296 | 6/1989 | Biek | 173/93.5 |
| 4,920,836 | 5/1990 | Sugimoto et al. | 173/93.5 |
| 5,092,410 | 3/1992 | Wallace et al. | 173/93.5 |

FOREIGN PATENT DOCUMENTS

| | | |
|---|---|---|
| 0 185 639 | 6/1986 | European Pat. Off. . |
| 0 186 316 | 7/1986 | European Pat. Off. . |

*Primary Examiner*—Joseph J. Hail, III
*Assistant Examiner*—Jay A. Stelacone
*Attorney, Agent, or Firm*—Frishauf, Holtz, Goodman, Langer & Chick

[57] ABSTRACT

A hydraulic torque impulse mechanism comprising a rotatively driven drive member (10) which has a concentric fluid chamber (12) as well as radially acting cams (25, 26, 28), an output shaft (16) which extends into the fluid chamber (12) and which has two radially extending cylinder bores (18, 19) communicating with each other via a central high pressure chamber (23), two oppositely disposed piston elements (20, 21) reciprocable in the cylinder bores (18, 19) by the cams (25, 26, 28), and two valve chambers (45, 46) each comprising a number of fluid communicating openings (50) interconnecting the high pressure chamber (23) and the drive member fluid chamber (12), and a pressure responsive leaf spring valve element(51) for blocking fluid communication through these openings (50) as the pressure difference between the high pressure chamber (23) and the fluid chamber (12) exceeds a certain level.

6 Claims, 2 Drawing Sheets

HYDRAULIC TORQUE IMPULSE MECHANISM

BACKGROUND OF THE INVENTION

This invention relates to a hydraulic torque impulse mechanism intended for a torque delivering tool and including a rotatively driven drive member provided with a concentric fluid chamber as well as a radially acting cam means, an output shaft extending into the drive member fluid chamber and having two radially extending cylinder bores which communicate continuously with each other via a central high pressure chamber, and two oppositely disposed piston elements reciprocable in the cylinder bores by the cam means.

An impulse mechanism of the above type, disclosed for example in U.S. Pat. No. 5,092,410, is characterized by a very efficient impulse generation, because the volume of the high pressure chamber is very small and the fluid entrapped therein is compressed simultaneously from two opposite directions. This type of impulse mechanism is characterized also by a high tightness of the high pressure chamber, which means that the pressure difference between the high pressure chamber and the drive member fluid chamber persists for an extended time interval following each impulse generation. This brings two disadvantages, namely severe vibrations in the tool housing due to the motor torque influence during the extended time interval and a low impulse rate due to a low mean speed of the drive member in relation to the output shaft. A low impulse rate means a low power output of the impulse mechanism.

In order to increase the mean speed of the drive member and, accordingly, the impulse rate and to reduce vibrations in the tool housing, a compromise has been made in prior art impulse mechanisms, namely the provision of one or more permanent leak openings between the high pressure chamber and the surrounding drive member fluid chamber. Such permanent leak openings for reducing the cycle time and increasing the impulse rate cause, however, an undesirable reduction of the impulse magnitude.

The basic idea behind the invention is to provide an impulse mechanism of the above identified type in which a pressure responsive valve means is arranged to allow fluid communication via one or more openings between the high pressure chamber and the drive member fluid chamber as long as the pressure difference between these chambers is below a certain level, but to block such fluid communication as the pressure difference exceeds this level. Thereby, the impulse rate is increased and the vibration level is decreased.

This principle, however, is previously known per se and has been applied on other types of impulse mechanisms as described in U.S. Pat. No. 3,283,537 and U.S. Pat. No. 4,683,961.

SUMMARY OF THE INVENTION

The main object of the invention is to provide an impulse mechanism wherein the output shaft comprises at least one valve chamber which communicates continuously with the high pressure chamber openings connecting the high pressure chamber within the output shaft to the surrounding drive member fluid chamber, and a pressure responsive valve means which is arranged to control the fluid communication through the openings between the high pressure chamber and the drive member fluid chamber such that the openings are blocked as the pressure difference between the high pressure chamber and the fluid chamber exceeds a certain level.

Another object of the invention is to provide an impulse mechanism having two valve chambers formed by a transverse bore extending through the output shaft perpendicularly to the cylinder bores and intersecting the high pressure chamber, and which are defined by two end closures forming a support means for the valve means and comprising the fluid communication openings.

Further characterictics and advantages of the invention will appear from the following specification.

BRIEF DESCRIPTION OF THE DRAWINGS

A preferred embodiment of the invention is described below in detail with reference to the accompanying drawings in which.

DETAILED DESCRIPTION

Figure 1:
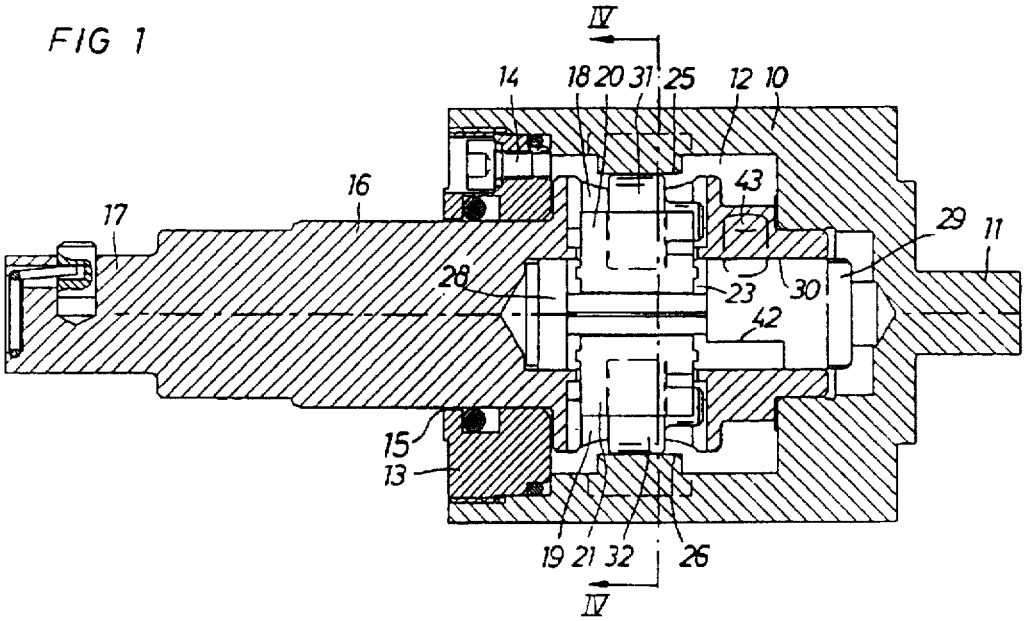
FIG. 1 shows a longitudinal section through an impulse mechanism according to the invention.

The impulse mechanism shown in the drawing figures is particularly intended for a screw joint tightening tool and comprises a drive member 10 rotatively driven by a motor (not shown) via a rear stub axle 11.

The drive member 10 is formed with a concentric fluid chamber 12 which at its forward end is closed by a threaded annular end wall 13. The latter is provided with an fluid filler plug 14.

The end wall 13 is also formed with a central opening 15 which forms a plain bearing for an output shaft 16. The latter extends by its rear end into the fluid chamber 12 and is formed with a square portion 17 at its forward end for connection to a standard type nut socket. At its inner end, the output shaft 16 is provided with two radially directed cylinder bores 18, 19 which extend coaxially relative to each other. Within these cylinder bores 18, 19 there are movably guided piston elements 20, 21 defining between them a central high pressure chamber 23.

The drive member 10 is provided with a cam means for accomplishing controlled radial reciprocating movements of the piston elements 20, 21 at relative rotation between the drive member 10 and the output shaft 16. The cam means comprises a cam surface 24 with two 180 degrees spaced cam lobes 25, 26 on the cylindrical wall of the fluid chamber 12, and a central cam spindle 28. The latter is connected to the drive member 10 by means of a claw type clutch 29 and extends into a coaxial bore 30 in the output shaft 16. At relative rotation between the drive member 10 and the output shaft 16, the cam lobes 25, 26 on the fluid chamber wall act to urge simultaneously both piston elements 20, 21 inwardly, toward each other. With a 90° phase lag in relation to the cam lobes 25, 26, the cam spindle 28 acts on the piston elements 20, 21 to move the latters outwardly into positions where they again can be activated by the cam lobes 25, 26.

Figure 2:
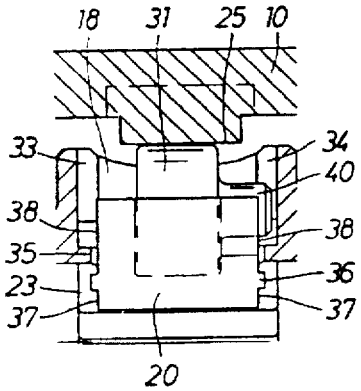
FIG. 2 shows, on a larger scale, a fragmentary view of the mechanism in FIG. 1.
Figure 5A:
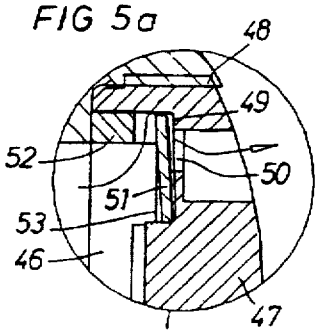
FIGS. 5*a*, *b*, *c* show, on a larger scale, fragmentary views of the valve means according to the invention, illustrating the valve means in alternative positions.
Figure 3:
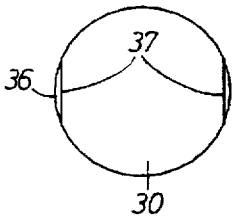
FIG. 3 shows an and view of a piston element.

As apparent from FIGS. 1, 2 and 3, each of the piston elements 20, 21 comprises a cylindrical cup-shaped body and a roller 31 and 32, respectively. The purpose of the rollers 31, 32 is to reduce the frictional resistance between the piston element and the cam lobes 25, 26.

The cylinder bores 18, 19 are formed with longitudinal grooves 33, 34 which extend from the outer ends of the bores 18, 19 but do not reach the inner ends of the bores 18, 19. A circular cylindrical seal portion 35 is left for sealing cooperation with a circular seal portion 36 on the piston elements 20, 21. The seal portion 36 is located between outer flat portions 37 and inner flat portions 38 whereby is formed by-pass passages past the seal portion 35 as the seal portion 36 on the piston element 20, 21 is out of register with the seal portion 35. See FIG. 2.

In order to lock the piston elements 20, 21 against rotation and to ensure that the flat portions 37, 38 are always aligned with the grooves 33, 34, each roller 32 is formed with an axial extension 40 which is partly received and guided in one of the grooves 34.

For avoiding two torque impulses to be generated during each relative revolution between the drive member 10 and the output shaft 16, the cam spindle 28 is formed with a flat portion 42 which is arranged to open up a communication between the high pressure chamber 23 and the fluid chamber 12 by cooperating once every relative revolution with a radial opening 43 in the output shaft 16. See FIG. 1.

Moreover, the output shaft 16 is provided with two each other opposite valve chamber 45, 46. These valve chambers 45, 46 are formed by a diametrically extending bore which intersects the cylinder bores 18, 19 as well as the axially extending bore 30. Each one of the valve chambers 45, 46 is defined by an end closure 47 which is secured to the output shaft 16 by a thread connection 48. The end closure 47 comprises a number of openings 50 for fluid communication between the high pressure chamber 23 and the fluid chamber 12.

Figure 4A:
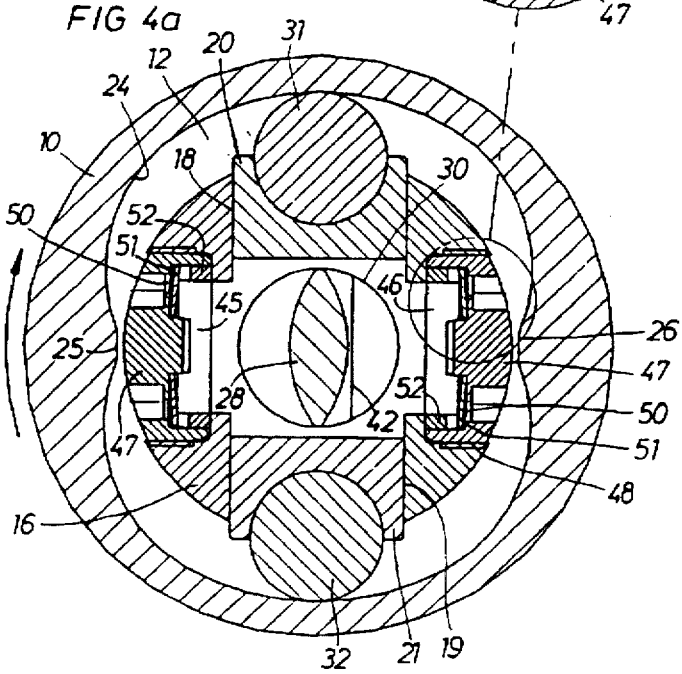
FIGS. 4*a*, *b*, *c* show cross sections along line IV—IV in FIG. 1 illustrating three different relative positions of the impulse mechanism.

Each end closure 47 provides an annular valve seat 49 and serves as a mounting means for a Belleville-type spring washer valve element 51. It also serves as a retaining means for a support ring 52. The latter is formed with axial teeth 53 by which the valve element 51 is kept in place when inactivated. Each valve element 51 is preformed to a conical shape in which it occupies an unseated open position, but is elastically deformable to a closed seated position as the pressure difference between the high pressure chamber 23 and the surrounding fluid chamber 12 exceeds a certain level. See FIGS. 4*a, b, c* and 5*a, b,c*.

In operation, the output shaft 16 is connected to a screw joint to be tightened by means of a nut socket attached to the square portion 17, and the drive member 10 is rotated by a motor via the stub axle 11.

During the running down phase of the tightening process, the torque resistance from the screw joint is very low. This means that the cam lobes 25, 26 are not able to move the piston elements 20, 21 against the fluid pressure in the high pressure chamber 23 and that the output shaft 16 rotates together with the drive member 10. At this stage the seal portions 36 on the piston elements 20, 21 have just reached the seal portions 35 in the cylinder bores 18, 19, thereby closing the high pressure chamber 23.

Figure 5B:
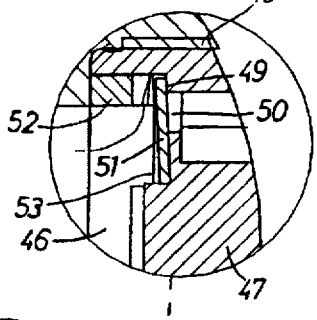
Figure 4B:
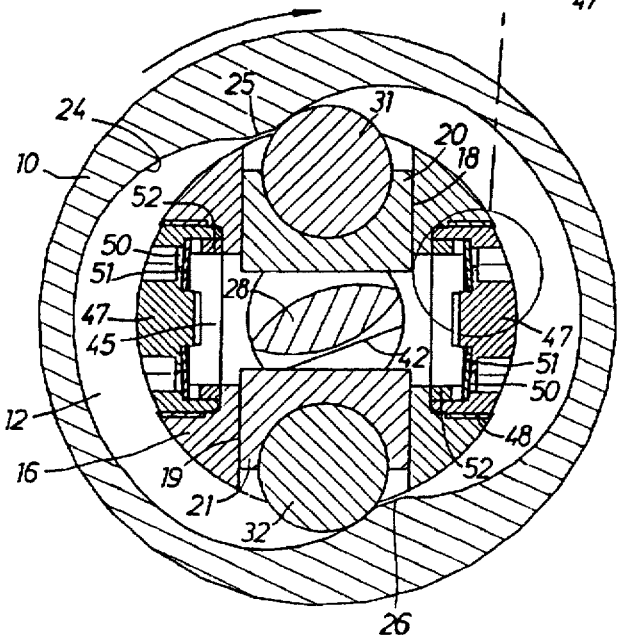

As the screw joint is run down and the pretensioning phase starts, the cam lobes 25, 26 urge the piston elements 20, 21 vigorously toward each other. This results in a decreasing volume of the high pressure chamber 23 and a fluid escape past the valve elements 51 and out through the openings 50. Due to the flow restriction across the valve elements 51, the fluid pressure within the high pressure chamber 23 increases rapidly. This means that the pressure difference between the high pressure chamber 23 and the fluid chamber 12 rapidly reaches the level where the valve elements 51 are deformed to their closed positions in which they cooperate sealingly with the valve seats 49 and, thereby, block fluid communication through the openings 50. See FIGS. 4*b*, 5*b*. After that, the pressure within the high pressure chamber 23 increases to a peak Level to generate a torque impulse in the output shaft 16.

Figure 5C:
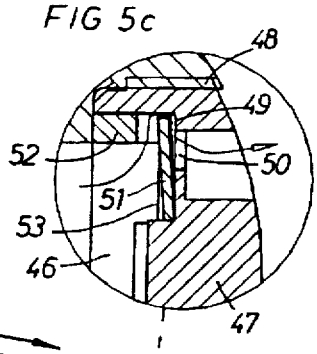
Figure 4C:
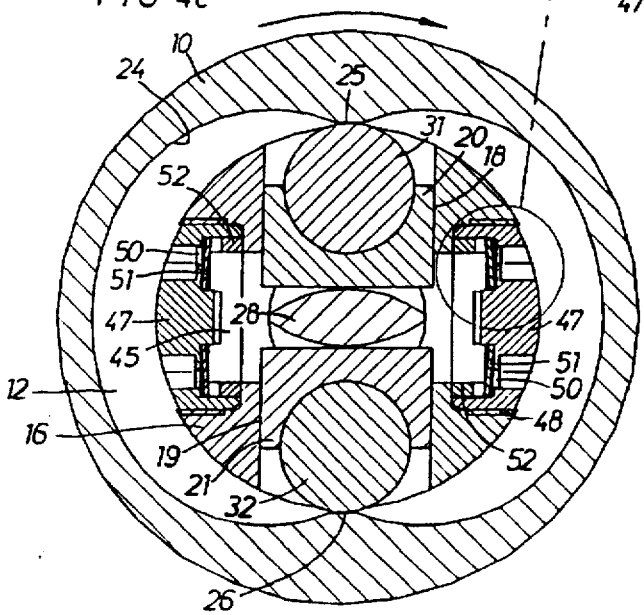

When all the kinetic energy of the drive member 10 has been transformed into fluid pressure and further to a torque impulse in the output shaft 16, the pressure within the high pressure chamber 23 decreases below the level where the valve elements 51 are kept in their closed positions. The torque delivered by the motor continues to rotate the drive member 10 relative to the output shaft 16, and since the valve elements 51 have reopened the fluid communication through the openings 50, fluid now escapes through the latters and the pressure within the high pressure chamber 23 drops rapidly. The cam lobes 25, 26 are able to pass the center of the piston elements 20, 21 without any resistance from the fluid pressure acting on the piston elements 20, 21. See FIGS. 4*c* and 5*c*.

After a short further rotation of the drive member 10, the seal portions 36 of the piston elements 20, 21, have passed the seal portions 35 in the cylinder bores 18, 19 and the sealing cooperation therebetween has ceased. This means that the drive member 10 is able to start accelerating before the next impulse to be generated without any delay due to remaining fluid pressure in the high pressure chamber 23. This means in turn shorter impulse generating cycles and a higher impulse rate.

During the drive member 10 acceleration phase, the piston elements 20, 21 are urged outwardly by the cam spindle 28, whereby hydraulic fluid is sucked into the high pressure chamber 23 through the openings 50, past the valve elements 51. The valve elements 51 are kept in place by the support rings 52.

When the seal portions 35 and 36 are out of register, the high pressure chamber 23 is refilled also via the grooves 33, 34 in the cylinder bores 18, 19 and the flat portions 37, 38 on the piston elements 20, 21.

In the above described example the pressure responsive valve elements 51 comprise annular spring washers of a somewhat conical nominal shape. Alternatively, the valve elements 51 may comprise two conical spring washers sandwiching a flat plate, or the valve element 51 may comprise single or double flat plates only. Accordingly, the embodiments of the invention are not limited to the described example but could be varied within the scope of the claims.

I claim:

1. Hydraulic torque impulse mechanism, comprising a rotatively driven drive member (10) provided with a concentric fluid chamber (12) as well as a radially acting cam means (25,26,28), an output shaft (16) extending through said drive member fluid chamber (12) and having two radially extending cylinder bores (18,19) which communicate continuously with each other via a central high pressure chamber (23), and two oppositely disposed piston elements (20,21) which are reciprocable in said cylinder bores (18,19) by said cam means (25,26,28), characterized in that said output shaft (16) comprises at least one valve chamber (45,46) which communicates continuously with said high pressure chamber (23), said at least one valve chamber (45,46) comprises one or more fluid communicating openings (50) for connecting said high pressure chamber (23) to said drive member fluid chamber (12), and a pressure responsive valve means (51) arranged to block said one or more fluid communicating openings (50) as the pressure difference between said high pressure chamber (23) and said drive member fluid chamber (12) exceeds a certain level.

2. Impulse mechanism according to claim 1, wherein said at least one valve chamber (45,46) is two in number and formed by a transverse bore extending through said output shaft (16) perpendicularly to said cylinder bores (18,19) and intersecting said high pressure chamber (23), said valve chambers (45,46) being defined by two end closures (47) comprising said fluid communicating openings (50) and forming a support for said valve means (51).

3. Impulse mechanism according to claim 1 wherein said valve means (51) comprises one or more leaf spring elements.

4. Impulse mechanism according to claim 1 wherein said valve means (51) comprises one or more Belleville-type spring washers.

5. Impulse mechanism according to claim 2, wherein said valve means (51) comprises one or more leaf spring elements.

6. Impulse mechanism according to claim 2, wherein said valve means (51) comprises one or more Belleville-type spring washers.

* * * * *